US010887963B2

(12) United States Patent
Witkowski et al.

(10) Patent No.: US 10,887,963 B2
(45) **Date of Patent: *Jan. 5, 2021**

(54) MULTI-MODE POWER SUPPLY FOR AN LED ILLUMINATION DEVICE

(71) Applicant: SIGNIFY HOLDING B.V., Eindhoven (NL)

(72) Inventors: Joseph J. Witkowski, Syracuse, NY (US); Joseph R. Casper, Syracuse, NY (US); Christopher D. Nolan, Syracuse, NY (US); Benjamin David Vollmer, Manlius, NY (US)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

This patent is subject to a terminal disclaimer.

(21) Appl. No.: 16/282,425

(22) Filed: Feb. 22, 2019

(65) Prior Publication Data

US 2019/0191509 A1 Jun. 20, 2019

Related U.S. Application Data

(63) Continuation of application No. 15/392,219, filed on Dec. 28, 2016, now Pat. No. 10,251,225.

(60) Provisional application No. 62/271,580, filed on Dec. 28, 2015.

(51) Int. Cl.
*H05B 45/37* (2020.01)
*H05B 45/10* (2020.01)

(52) U.S. Cl.
CPC ..... *H05B 45/37* (2020.01); *H05B 45/10* (2020.01)

(58) Field of Classification Search
CPC ..... H05B 33/0815; H05B 33/0845
USPC ..... 315/307
See application file for complete search history.

(56) References Cited

U.S. PATENT DOCUMENTS

| | | | | |
|---|---|---|---|---|
| 8,823,274 | B2 | 9/2014 | Van Erp | |
| 8,866,401 | B2 | 10/2014 | Shearer et al. | |
| 8,994,276 | B2 | 3/2015 | Recker et al. | |
| 9,313,839 | B2 | 4/2016 | Viviani et al. | |
| 9,504,099 | B2 | 11/2016 | McGuire et al. | |
| 2008/0129219 | A1 | 6/2008 | Smith et al. | |
| 2008/0224636 | A1* | 9/2008 | Melanson | H05B 33/0815 315/307 |
| 2008/0303661 | A1 | 12/2008 | Chick | |
| 2012/0112641 | A1 | 5/2012 | Leshniak | |
| 2013/0033176 | A1* | 2/2013 | Hebborn | F21V 23/004 315/35 |
| 2014/0042930 | A1* | 2/2014 | Chen | G09G 3/3696 315/294 |
| 2014/0265845 | A1 | 9/2014 | Williams | |
| 2014/0306609 | A1 | 10/2014 | Kang et al. | |

(Continued)

*Primary Examiner* — Don P Le
(74) *Attorney, Agent, or Firm* — Patrick T. Driscoll

(57) ABSTRACT

A power supply unit for an illumination device that includes a multi-mode power supply configured to supply power to an illumination device having one or more LED modules and a control circuit. The multi-mode power supply includes a primary power supply component configured to supply power to non-essential components of the illumination device, and a secondary power supply component configured to supply power to only essential components of the illumination device. The nonessential components include the one or more LED modules, and the essential components include the control circuit but not the one or more LED modules.

19 Claims, 5 Drawing Sheets

(56) References Cited

U.S. PATENT DOCUMENTS

| | | | |
|---|---|---|---|
| 2015/0008844 | A1 | 1/2015 | Wilson |
| 2016/0027267 | A1 | 1/2016 | Spiro |
| 2017/0051886 | A1 | 2/2017 | Liu et al. |
| 2017/0127493 | A1 | 5/2017 | Woytowitz |
| 2017/0188423 | A1 | 6/2017 | Witkowski et al. |

* cited by examiner

MULTI-MODE POWER SUPPLY FOR AN LED ILLUMINATION DEVICE

RELATED APPLICATIONS AND CLAIM OF PRIORITY

This application claims priority to, and is a continuation of U.S. patent application Ser. No. 15/392,219, filed Dec. 28, 2016 which in turn claims priority to U.S. provisional patent application No. 62/271,580, filed Dec. 28, 2015, the disclosures of which are hereby incorporated by reference in full.

BACKGROUND

The advent of light emitting diode (LED) based luminaires has provided sports arenas, stadiums, other entertainment facilities, and other commercial and industrial facilities the ability to achieve instant on-off capabilities, intelligent controls and adjustability while delivering excellent light quality, consistent light output, and improved energy efficiency. Because of this, users continue to seek improvements in LED lighting devices. For example, new and improved ways to direct light in multiple directions, and to provide luminaires with high light output in a compact package, are desired.

Typical LED lighting devices have a lag time when turned on because when the LED lighting device is turned off, power supply to its control circuitry is also turned off. Hence, power first needs to be supplied to the control circuitry to turn it on, before turning on the LED lighting device itself.

This document describes a low power mode for a control card directed to solving the issues described above, and/or other problems.

SUMMARY

In certain embodiments, a power supply unit for an illumination device is disclosed. The power supply unit may include a multi-mode power supply configured to supply power to an illumination device having one or more LED modules and a control circuit. The multi-mode power supply may include a primary power supply component configured to supply power to non-essential components of the illumination device, and a secondary power supply component configured to supply power to only essential components of the illumination device. The nonessential components may include the one or more LED modules, and the essential components may include the control circuit but not the one or more LED modules.

In an embodiment, the power supply unit may also include a controller element, and a communications interface. The controller element may be configured to turn the primary power supply component off in response to receiving a low power mode command via the communication interface. Optionally, the controller element may be configured to turn the primary power supply component back on in response to receiving a disable low power mode command via the communication interface. Additionally and/or alternatively, the controller may be configured to enable the secondary power supply in response to receiving a command to turn the illumination device off and/or disable the secondary power supply upon determining that the illumination device has been turned back on. In some embodiments, the controller element may also turn off the primary power supply component and turn on the secondary power component upon determining that an operational state of the illumination device is off, idling, or standby for a threshold period of time.

In certain embodiments, the primary power supply component may be configured to supply about 25 V to about 30 V output voltage, and the secondary power supply component may be configured to supply about 4 V to about 7 V output voltage.

In at least one embodiment, the power supply unit may also include a heat sink. Optionally, the power density of the power unit may be about 7.5 W/in$^3$, about 8.5 W/in$^3$, about 9 W/in$^3$, about 9.5 W/in$^3$, or about 10 W/in$^3$. The heat sink may include a plurality of fins having a perpendicular orientation with respect to a plane of an interface that is configured to connect the power supply module to the illumination device.

DETAILED DESCRIPTION

Figure 1:
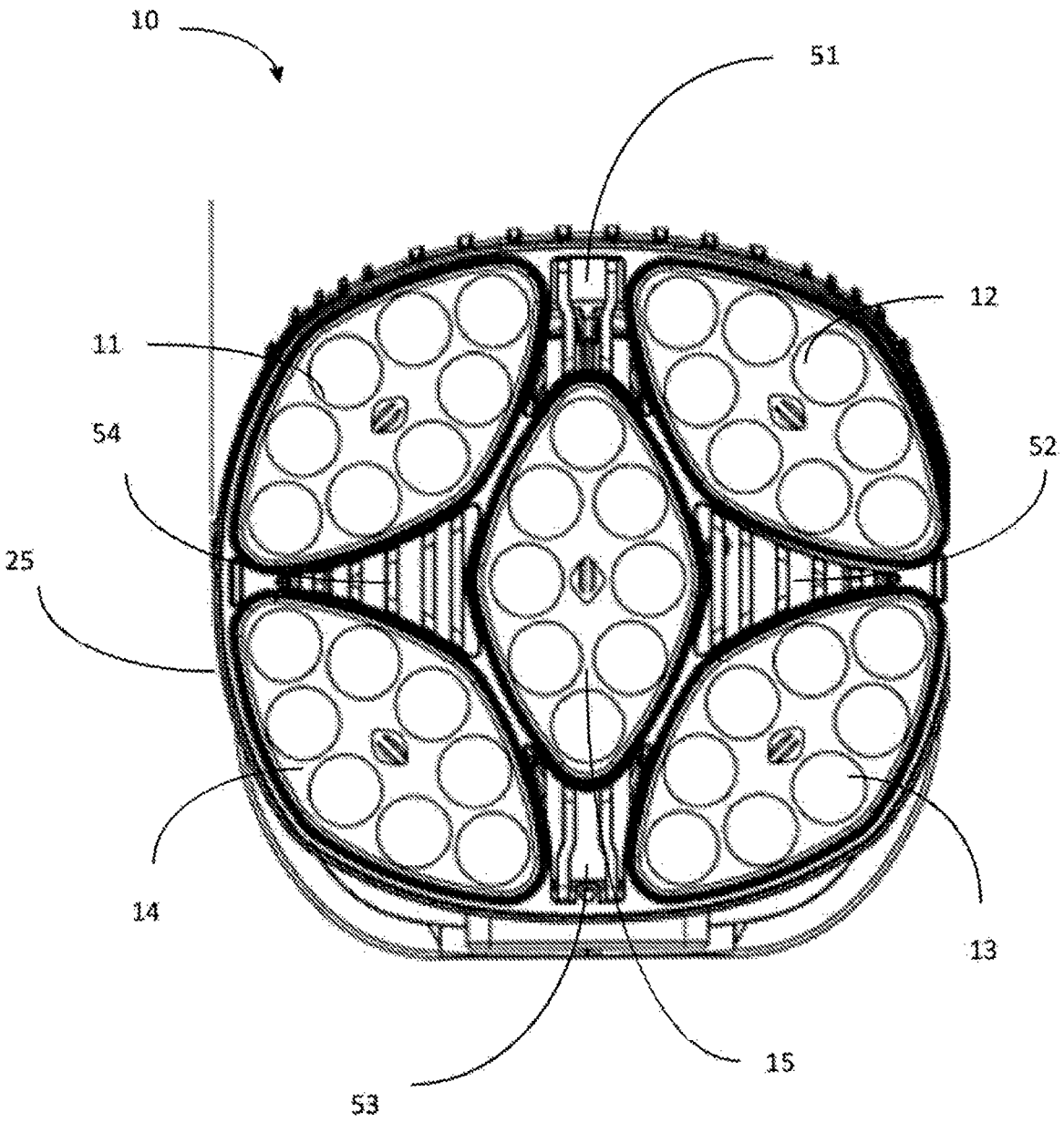
FIG. 1 illustrates a front view of an example of one embodiment of the illumination devices disclosed in this document.

As used in this document, the singular forms "a," "an," and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to."

When used in this document, terms such as "top" and "bottom," "upper" and "lower", or "front" and "rear," are not intended to have absolute orientations but are instead intended to describe relative positions of various components with respect to each other. For example, a first component may be an "upper" component and a second component may be a "lower" component when a light fixture is oriented in a first direction. The relative orientations of the components may be reversed, or the components may be on the same plane, if the orientation of a light fixture that contains the components is changed. The claims are intended to include all orientations of a device containing such components.

A "computing device" or "electronic device" refers to an electronic device having a processor and memory an d/or a communication device that can access a memory device. A communication device of an electronic device may include, for example, a short range wireless communication interface such as a transmitter, a near field communication (NFC) or radio frequency identifier (RFID) tag or Bluetooth Low Energy (BLE) receiver (with reduced transmit power), a processor and non-transitory, computer-readable memory. The memory will contain or receive programming instructions that, when executed by the processor, will cause the electronic device to perform one or more operations according to the programming instructions. Examples of electronic devices include personal computers, servers, mainframes, virtual machines, containers, gaming systems, televisions, and mobile electronic devices such as smartphones, wearable virtual reality devices, Internet-connected wearables such as smart watches and smart eyewear, personal digital assistants, tablet computers, laptop computers, media players and the like. Electronic devices also may include appliances and other devices that can communicate in an Internet-of-things arrangement, such as smart thermostats, home controller devices, voice-activated digital home assistants, connected light bulbs and other devices. In a client-server arrangement, the client device and the server are electronic devices, in which the server contains instructions and/or data that the client device accesses via one or more communications links in one or more communications networks. In a virtual machine arrangement, a server may be an electronic device, and each virtual machine or container may also be considered to be an electronic device. In the discussion below, a client device, server device, virtual machine or container may be referred to simply as a "device" for brevity.

"Electronic communication" refers to the ability to transmit data via one or more signals between two or more electronic devices, whether through a wired or wireless network, and whether directly or indirectly via one or more intermediary devices.

In this document, the terms "processor" and "processing device" refer to a hardware component of an electronic device that is configured to execute programming instructions. Except where specifically stated otherwise, the singular term "processor" or "processing device" is intended to include both single-processing device embodiments and embodiments in which multiple processing devices together or collectively perform a process.

In this document, the terms "memory," "memory device," "data store," "data storage facility" and the like each refer to a non-transitory device on which computer-readable data, programming instructions or both are stored. Except where specifically stated otherwise, the terms "memory," "memory device," "data store," "data storage facility" and the like are intended to include single device embodiments, embodiments in which multiple memory devices together or collectively store a set of data or instructions, as well as individual sectors within such devices.

A "controller device" is an electronic device that is configured to execute commands to control one or more other devices or device components, such as driving means of illumination device, illumination devices, etc. A "controller card" or "control card" or "control module" or "control circuitry" refers to a circuit component that acts as the interface between an input interface (such as an input interface of a controller device) and a lighting device.

Figure 2:
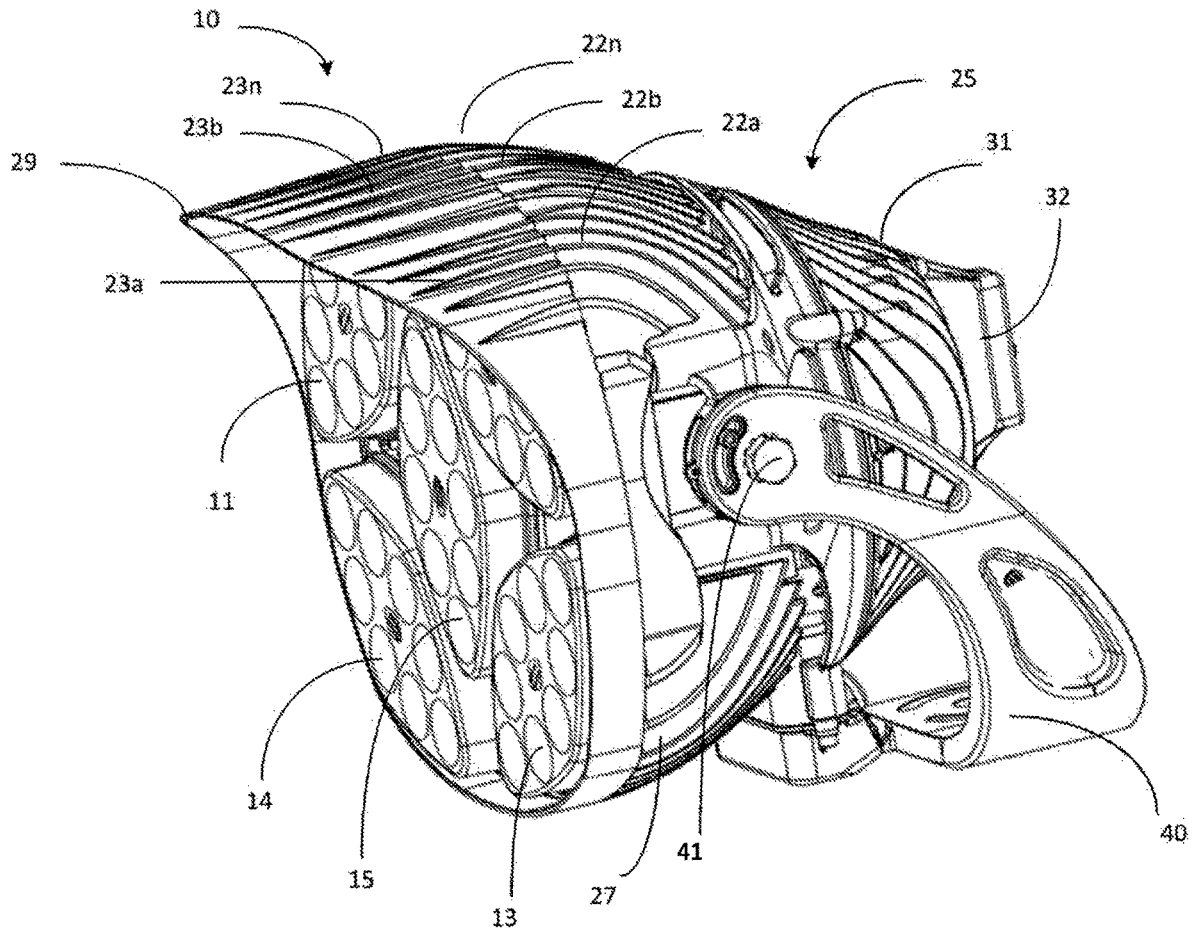
FIG. 2 illustrates a view from one side of the device of FIG. 1.

FIG. 1 illustrates a front view of an example of one embodiment of the illumination devices disclosed in this document. FIG. 2 illustrates a view from one side of the device of FIG. 1, while FIG. 2 provides a perspective view. The illumination device 10 includes a housing 25 that encases various components of a light fixture. As shown in FIG. 1, the housing 25 includes an opening in which a set of light emitting diode (LED) modules 11-15 are secured to form a multi-module LED structure. The LED modules 11-15 are positioned to emit light away from the fixture. Each LED module includes a frame that holds a set of LEDs arranged in an array or other configuration. In various embodiments the number of LEDs in each module may be any number that is sufficient to provide a high intensity LED device. Each LED module will also include a substrate on which the LEDs, various conductors and/or electronic devices, and lenses for the LEDs are mounted.

The opening of the housing 25 may be circular, square, or a square with round corners as shown in FIG. 1, although other shapes are possible. The LED modules 11-15 may include five modules as shown, with four of the modules 11-14 positioned in a quadrant of the opening and the fifth module 15 positioned in the center as shown. Alternatively, any other number of LED modules, such as one, two, three, four or more LED modules, may be positioned within the opening in any configuration.

The device's housing 25 includes a body portion 27 and an optional shroud portion 29. The body portion 27 serves as a heat sink that dissipates heat that is generated by the LED modules. The body/heat sink 27 may be formed of aluminum and/or other metal, plastic or other material, and it may include any number of fins 22*a* . . . 22*n* on the exterior to increase its surface area that will contact a surrounding cooling medium (typically, air). Thus, the body portion 27 or the entire housing 25 may have a bowl shape as shown, the LED modules 11-15 may fit within the opening of the bowl, and heat from the LED modules 11-15 may be drawn away from the LED modules and dissipated via the fins 22*a* . . . 22*n* on the exterior of the bowl.

While the LED modules are positioned at the front of body portion 27, the opposing side of the body portion may be attached to a power supply unit 31, optionally via a thermal interface plate. The power supply unit 31 may include a battery, solar panel, or circuitry to receive power from an external and/or other internal source. A power supply unit 31 may be positioned at the rear of the body (i.e., at the bottom of the bowl), and the interior of the unit may include wiring or other conductive elements to transfer power and/or control signals from the power supply unit 31 to the LED modules 11-15. The power supply 31 may be positioned at or near the rear of the body as shown, or it may be placed into the housing so that it is flush or substantially flush with the rear of the body 27, or it may be configured to extend to some point between being flush with the body portion 27 and an extended position. A sensor cavity 32 may be attached to the power supply and/or other part of the device as shown, and it may contain sensors and/or control and communications hardware for sensing parameters of and controlling the device, receiving commands, and transmitting data to remote control devices.

The housing 25 may be formed as a single piece, or it may be formed of two pieces that fit together as in a clamshell-type structure. In a clamshell design, a portion of the interior wall of the clamshell near its opening may include a groove, ridge, or other supporting structure that is configured to receive and secure the LED structure in the opening when the clamshell is closed. In addition, the fins 22*a* . . . 22*n* may be curved or arced as shown, with the base of each fin's curve/arc positioned proximate the opening/LED modules, and the apex of each fin's curve/arc positioned distal from the opening/LED modules to further help draw heat away from the LED modules. The housing may be attached to a support structure 40, such as a base or mounting yoke, optionally by one or more connectors 41. As shown, the connectors 41 may include axles about which the housing and/or support structure may be rotated to enable the light assembly to be positioned to direct light at a desired angle.

The power supply unit 31 may be detachable from remainder of the lighting device's housing 25 so that it can be replaced and/or removed for maintenance without the need to remove the entire device from an installed location, or so that it can be remotely mounted to reduce weight. The power supply unit 31 and/or a portion of the lighting unit housing 25 may include one or more antennae, transceivers or other communication devices that can receive control signals from an external source. For example, the illumination device may include a wireless receiver and an antenna that is configured to receive control signals via a wireless communication protocol. Optionally, a portion of the lighting unit housing 25 or shroud 29 (described below) may be equipped with an attached laser pointer that can be used to identify a distal point in an environment to which the lighting device directs its light. The laser pointer can thus help with installation and alignment of the device to a desired focal point.

FIGS. 1 and 2 show that the device may include a shroud 29 that protects and shields the LED modules 11-15 from falling rain and debris, and that may help direct light toward an intended illumination surface. The shroud 29 may have any suitable width so that an upper portion positioned at the top of the housing is wider than a lower portion positioned at the bottom and/or along the sides of the opening of the housing. This may help to reduce the amount of light wasted to the atmosphere by reflecting and redirecting stray light downward to the intended illumination surface. FIG. 2 illustrates that in an embodiment, some or all of the fins of the housing 22*a*-22*n* may be contiguous with fin portions 23*a*-23*n* that extend across the shroud 29. With this option, the shroud 29 can also serve as part of the heat sink.

The fins 22*a* . . . 22*n* may be positioned substantially vertically (i.e., lengthwise from a top portion of the LED array structure and shroud 29 to a bottom portion of the same). Optionally, one or more lateral supports may be interconnected with the fins to provide support to the housing. The lateral supports may be positioned substantially parallel to the axis of the fins, or they may be curved to extend away from the LED structure, or they may be formed of any suitable shape and placed in any position. Each support may connect two or more of the fins. The fins and optional supports form the body portion 27 as a grate, and hot air may rise through the spaces that exist between the fins and supports of the grate. In addition, precipitation may freely fall through the openings of the grate. In addition, any small debris (such dust or bird droppings) that is caught in the grate may be washed away when precipitation next occurs.

Figure 3:
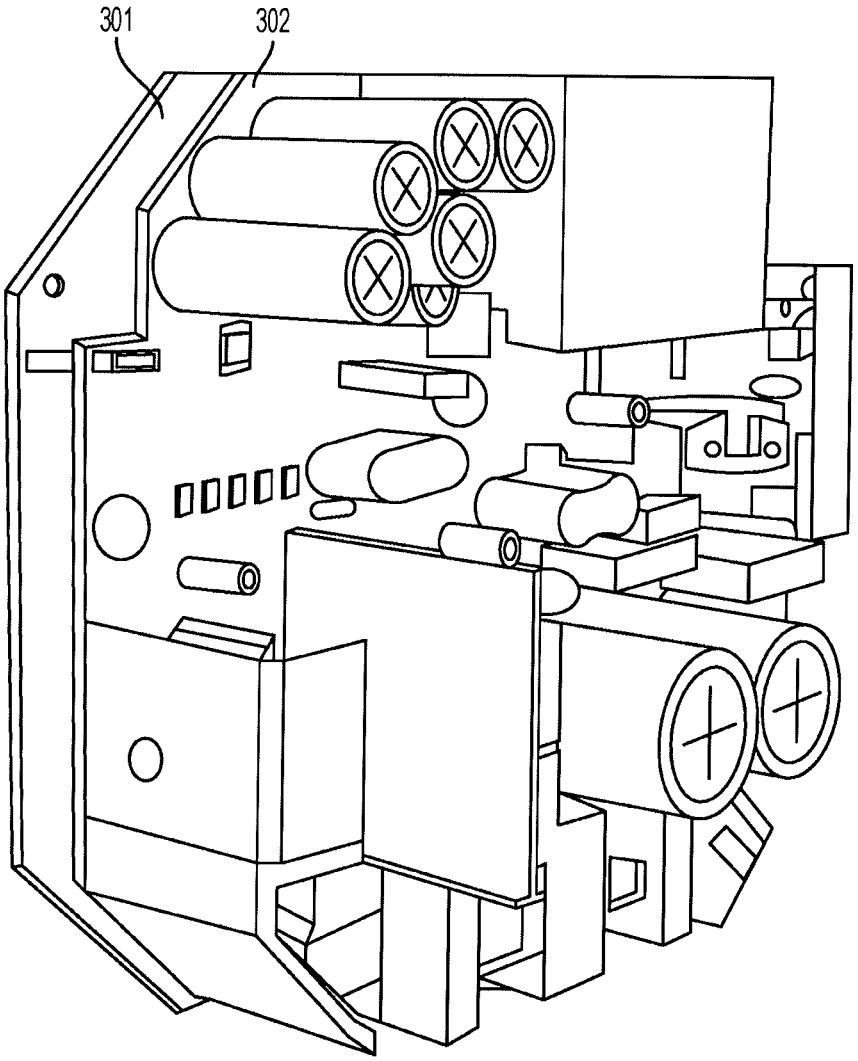
FIG. 3 illustrates an example power supply board, according to an embodiment.

FIG. 3 illustrates an example power supply module (or board) 301 in electrical communication with a control circuit board 302 of an illumination device, according to an embodiment. As such FIG. 3 illustrates a staggered board configuration of a power supply module in conjunction with a control circuit board that are thermally insulated from each other. Thermal separation may be provided by, for example, a thermal insulating sheet, or the like.

Driver circuitry on the power supply module may supply power to the LEDs as well as the control circuit board. In an embodiment, the power supply module may include multi-wire connectors with prongs and/or receptacles for connecting to external conductors and/or signal wires in order to supply power to the control circuit board and/or LED modules. A power supply module may be positioned under, adjacent to or otherwise near the LED modules to provide power to the LEDs. The LEDs to which power is supplied may be selectively controlled by the control circuit board.

In an embodiment, the control circuit board (or control circuitry) 302 may include a supporting substrate made of a material such as fiberglass, and a non-transitory computable-readable memory for storing programming instructions and/or monitored data and/or operational history data, one or more processors, a field programmable gate array (FPGA), application specific integrated circuit (ASIC) or other integrated circuit structures, a receiver for receiving control signals from an external transmitter, and a transmitter for relaying signals to external devices. The control circuitry may also include a processor that monitors both wired and wireless communication interfaces and responds to each of them based on the input commands. The processor may include one or more rule sets for optimally monitoring input signals at both interfaces. In an embodiment, the control circuitry may also include a processor that monitors the power state of the lighting device and the operational state of the lighting device, and may include one or more rules sets for generating various commands to the power module.

In an embodiment, the power supply may also provide power to the control circuitry of the illumination device. Hence, a power supply unit may provide power to the LED modules and/or the circuit board. As discussed above, typically when power to the LED modules of an illumination device is switched off, power to the control circuitry is also turned off. However, it may be desirable to provide power to the control circuitry in order to reduce the power on lag time and/or to maintain functionality of the control circuitry. Hence, there exists a need for selectively turning off power supply to the LED lighting device but not to the control circuitry.

In some embodiments, a control circuitry of an illumination device may also include a communications interface for receiving a controller signal generated by a controller device. The system may include one or more controller devices that may generate control signals for controlling an illumination device and/or its power supply. The controller devices may include a user interface such as a touch screen, a keyboard or keypad, or a microphone and speech-to-text programming. Examples of controller devices may include, without limitation, an electronic device having a user interface such as a smart phone, tablet computing device or other computing device; a home voice assistant or other voice-controllable electronic device; a dedicated lighting control device such as a dimmer switch, or the like. A controller device may be a remote computing device that may provide monitoring and controlling capabilities for an illumination device. In an embodiment, a controller device may transmit control signals to a control signal communication module of an illumination device via one or more of control signal protocols discussed above.

The communications interface may receive wired and/or wireless communications from a controller device. Examples may include, without limitation, WiFi, short-range communications such as RFID, Bluetooth™ or Bluetooth™ low energy (BLE), cellular networks, Zigbee™, past and future versions of such protocols, and other similar networks and/or protocols. Additionally and/or optionally, various of the devices may communicate with the lighting devices via one or more lighting system control signal protocols such as analog (0-10V), digital addressable lighting interface (DALI™), digital multiplex (DMX512), DMX/RDM (wired and/or wireless), sACN (also known as Streaming ACN), pulse width modulation (PWM), $I^2C$, a near-field or short-range wireless communication protocol (BLE, Zigbee™, etc.) and other protocols, or via one or more devices such as a universal asynchronous receiver/transmitter (UART) device or DC or AC wires.

In an embodiment, the control circuitry may operate to initiate a low power mode lighting system, in response to receiving a "low power mode" command from a controller device at the communications interface. Alternatively and/or additionally, the control circuitry may generate a command for the power supply unit to enter a low power mode based on one or more rules. Example rules may include, without limitation, during off, idling or standby operating states of the lighting device of a threshold period of time, or the like.

Figure 4:
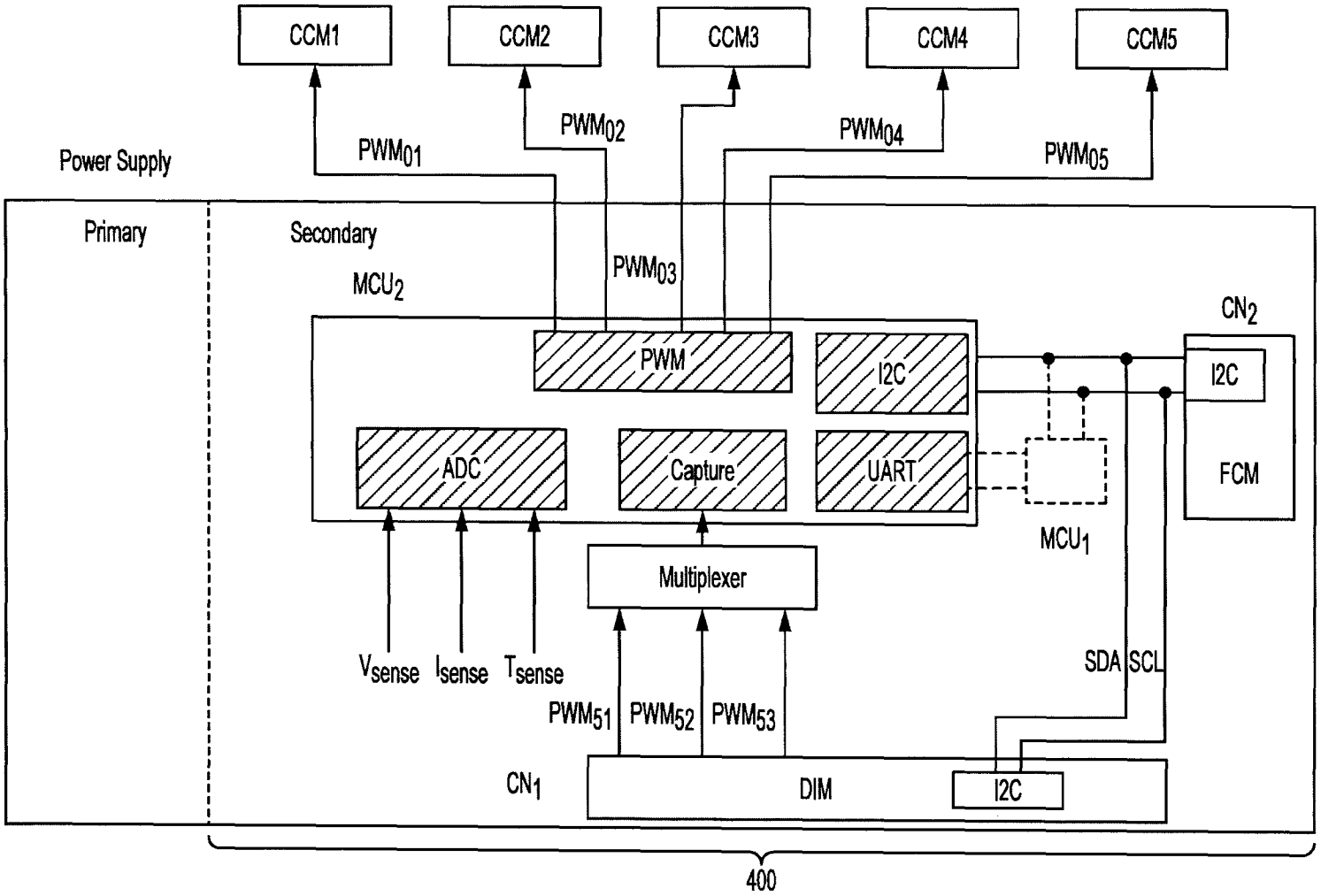
FIG. 4 illustrates an example block diagram of components that receive power from a secondary power supply circuit, according to an embodiment.

In the low power mode, all non-essential circuitry components of the system and the LEDs of the illumination device are turned off (i.e., their power supply is cut off), and only essential circuit components are kept on (i.e., power is supplied to these components). However, when the system is not operating in the low power mode, all the components of the control circuitry perform their standard functions such as receiving and/or transmitting all types of communication signals (such as input signals, telemetry data, control signal, or the like), control of the LED modules, and/or the like, and one or more LEDs of the LED illumination device may be turned on. Examples of the essential circuit components may include, without limitation, a low power communications interface (such as BLE) for receiving essential communications such as disable low power mode, essential power supply circuitry (such as power supply components for one or more of the control circuit cards), and other optional control circuit components. In an embodiment, the optional control circuit components may be variable and may be set by a user and/or a controlling device. FIG. 4 is a block diagram that illustrates an example of a set of essential circuit components 400 that may receive power when the low power mode is turned on.

In an embodiment, the power supply module may include a "primary power supply" circuit and a "secondary power supply" circuit. When the primary power supply circuit is supplying power, control circuitry of an illumination device may operate normally with all components of the control circuit card performing their standard functions, and one or more LEDs of the LED illumination device may be turned on. In contrast, when the secondary power supply circuit is supplying power, an illumination device operates in a low power mode, i.e., turns off all non-essential circuitry and the LED illumination device (as discussed above).

In an embodiment, when a low power mode is enabled, a controller element of the power module may switch the power supply source for the essential components of the control circuitry such that they draw power from the secondary power supply circuit and not the primary power supply circuit. In an example embodiment, an illumination device may draw about 25-30V output from the primary power supply circuit, but may only draw about 4-7V output from the secondary power supply circuit (low power mode). Hence, in a low power mode an illumination device fixture will only draw 1.72 W (0.23% of full load) at 277 VAC, 2.24 W (0.3% of full load) at 347 VAC, and 3.46 W (0.5% of full load) at 480 VAC.

The system may remain in a low power mode, once enabled, until it receives a disable low power mode command via the communications interface (such as BLE). In an embodiment, upon receipt of the disable low power mode command, the primary power supply circuit may become active without the need for an AC power cycle, since power to the control circuitry was never switched off.

In an embodiment, the secondary power supply circuit may automatically be enabled when an illumination device is turned off, and disabled when the illumination device is turned on again, in order to conserve energy.

Figure 5A:
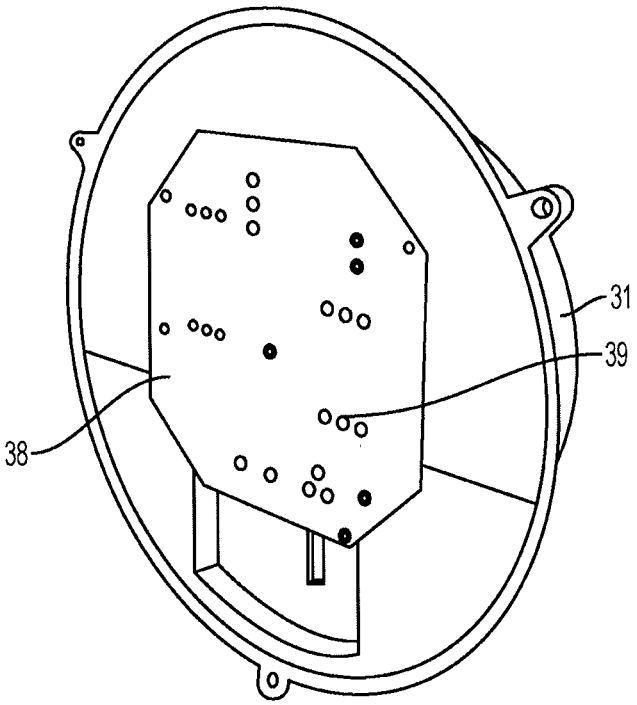
FIG. 5A and FIG. 5B illustrate a front view and a back view, respectively, of an example power supply unit, according to an embodiment.
Figure 5B:
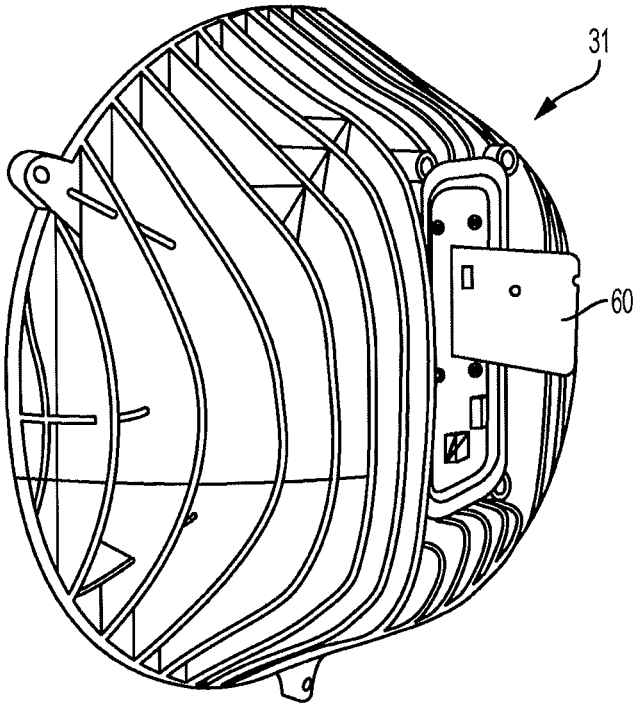

FIG. 5A illustrates a front view of an example power supply unit and FIG. 5B illustrates a back view of an example power supply unit. As shown in FIG. 5B, in an embodiment, the power supply unit 31 may also include its own custom heat sink. For example, the external housing of the power supply unit 31 also may include fins to help dissipate heat from the power supply. The fins of the power supply may perpendicular to the plane of interface between the lighting device's housing and the power supply unit 31, to help with heat dissipation. The fins of the power supply housing thus provide an additional heat sink that draws heat away from the power supply during operation. Such a thermal management for heat dissipation from the power supply unit (in addition to the low power mode switching circuit as described above) allows for maximization of power density of the power supply unit to from about 7.5 $W/in^3$ to about 10 $W/in^3$. This is in contrast to prior power supply unit limited to 5 $W/in^3$. For example, the power density of the power supply unit may be about 7.5 $W/in^3$, about 8 $W/in^3$, about 8.5 $W/in^3$, about 9 $W/in^3$, about 9.5 $W/in^3$, or about 10 $W/in^3$. As shown FIG. 5A, the power supply module may be connected to a substrate 38 on which a number of LEDs 39 are positioned. The substrate 38 may hold circuitry that provides electrical communication paths between the LEDs and the power supply an embodiment, the substrate 38 may also hold circuitry that provides electrical communication paths between the LEDs and a control card or a controller 60. In an example embodiment, the electrical communication may be an I'C communication protocol.

It is intended that the portions of this disclosure describing LED modules and control systems and methods are not limited to the embodiment of the illumination devices disclosed in this document. The LED modules, control systems and control methods may be applied to other LED illumination structures, such as those disclosed in U.S. Patent Application Pub. No. 2014/0334149 (filed by Nolan et al. and published Nov. 13, 2014), and in U.S. Patent Application Pub. No., 2015/0167937 (filed by Casper et al. and published Jun. 18, 2015), the disclosures of which are fully incorporated herein by reference.

The features and functions described above, as well as alternatives, may be combined into many other systems or applications. Various presently unforeseen or unanticipated alternatives, modifications, variations or improvements may be made by those skilled in the art, each of which is also intended to be encompassed by the disclosed embodiments.

The invention claimed is:

1. A power supply unit for an illumination device, the power supply unit comprising:

a multi-mode power supply configured to supply power to an illumination device having one or more light emitting diode (LED) modules and a control circuit, wherein the multi-mode power supply comprises:

a primary power supply component configured to supply power to a first plurality of components of the control circuit, a second plurality of components of the control circuit, and the one or more LED modules, and a secondary power supply component configured to supply power to only the second plurality of components of the control circuit, and not to the first plurality of components of the control circuit.

2. The power supply unit of claim 1, further comprising:

a controller element; and a communications interface, wherein the controller element is configured to turn the primary power supply component off in response to receiving a low power mode command via the communication interface.

3. The power supply unit of claim 1, wherein the controller element is further configured to turn the primary power supply component back on in response to receiving a disable low power mode command via the communication interface.

4. The power supply unit of claim 1, further comprising a controller element that is configured to enable the secondary power supply in response to receiving a command to turn the illumination device off.

5. The power supply unit of claim 4, wherein the controller is further configured to disable the secondary power supply upon determining that the illumination device has been turned back on.

6. The power supply unit of claim 1, further comprising a controller element that is configured to turn off the primary power supply component and turn on the secondary power component when the controller element determines that an operational state of the illumination device is off, idling, or standby for a threshold period of time.

7. The power supply unit of claim 1, wherein:

the primary power supply component is configured to supply about 25 V to about 30 V output voltage; and the secondary power supply component is configured to supply about 4 V to about 7 V output voltage.

8. The power supply unit of claim 1, further comprising a heat sink.

9. The power supply unit of claim 8, wherein the heat sink comprises a plurality of fins having a perpendicular orientation with respect to a plane of an interface that is configured to connect the power supply module to the illumination device.

10. The power supply unit of claim 8, wherein the power supply unit has a power density of approximately 7.5 W/in$^3$, approximately 8.5 W/in$^3$, approximately 9 W/in$^3$, approximately 9.5 W/in$^3$, or approximately 10 W/in$^3$.

11. A power supply unit for an illumination device, the power supply unit comprising:

a controller element;

a heat sink; and a multi-mode power supply configured to supply power to an illumination device having one or more LED modules and a control circuit, wherein the multi-mode power supply comprises:

a primary power supply component configured to supply power to a first plurality of components of the control circuit, a second plurality of components of the control circuit, and the one or more LED modules, and a secondary power supply component configured to supply power to only the second plurality of components of the control circuit, and not to the first plurality of components of the control circuit.

12. The power supply unit of claim 11, wherein the controller element is configured to turn the primary power supply component off in response to receiving a low power mode command.

13. The power supply unit of claim 12, wherein the controller element is further configured to turn the primary power supply component back on in response to receiving a disable low power mode command.

14. The power supply unit of claim 11, wherein the controller element is configured to enable the secondary power supply in response to receiving a command to turn the illumination device off.

15. The power supply unit of claim 14, wherein the controller element is further configured to disable the secondary power supply upon determining that the illumination device has been turned back on.

16. The power supply unit of claim 11, wherein the controller element is configured to turn off the primary power supply component and turn on the secondary power component when the controller element determines that an operational state of the illumination device is off, idling, or standby for a threshold period of time.

17. The power supply unit of claim 11, wherein:

the primary power supply component is configured to supply about 25 V to about 30 V output voltage; and the secondary power supply component is configured to supply about 4 V to about 7 V output voltage.

18. The power supply unit of claim 11, wherein the heat sink comprises a plurality of fins having a perpendicular orientation with respect to a plane of an interface that is configured to connect the power supply module to the illumination device.

19. The power supply unit of claim 18, wherein the power supply unit has a power density of approximately 7.5 W/in$^3$, approximately 8.5 W/in$^3$, approximately 9 W/in$^3$, approximately 9.5 W/in$^3$, or approximately 10 W/in$^3$.

* * * * *